US010526159B2

(12) United States Patent
Chen et al.

(10) Patent No.: US 10,526,159 B2
(45) Date of Patent: Jan. 7, 2020

(54) DISPENSER CONSTRUCTION STRING, CORD, OR WIRE

(71) Applicants: Cheng-Tsung Chen, Chunghua County (TW); Chao-Hui Lin, Ningbo (CN)

(72) Inventors: Cheng-Tsung Chen, Chunghua County (TW); Chao-Hui Lin, Ningbo (CN)

( * ) Notice: Subject to any disclaimer, the term of this patent is extended or adjusted under 35 U.S.C. 154(b) by 219 days.

(21) Appl. No.: 15/880,619

(22) Filed: Jan. 26, 2018

(65) Prior Publication Data

US 2019/0233246 A1 Aug. 1, 2019

(51) Int. Cl.
*B65H 49/20* (2006.01)
*B65H 75/10* (2006.01)

(52) U.S. Cl.
CPC ..... *B65H 49/205* (2013.01); *B65H 75/10* (2013.01); *B65H 2701/35* (2013.01)

(58) Field of Classification Search
CPC .. B65H 49/205; B65H 75/10; B65H 2701/35; B65H 2402/412; B65B 67/085
See application file for complete search history.

(56) References Cited

U.S. PATENT DOCUMENTS 4,102,513 A * 7/1978 Guard ..... B65B 67/085 156/577
4,166,589 A * 9/1979 Hoover ..... B65B 67/085 156/577
4,184,645 A * 1/1980 Starling ..... A01K 97/28 242/441
4,714,211 A * 12/1987 Hwang ..... B65B 67/085 242/423.1
RE34,376 E * 9/1993 Branback ..... B65H 49/305 242/129
6,079,663 A * 6/2000 Slater ..... B65H 49/205 242/129
7,401,449 B2 * 7/2008 Watson ..... B65B 67/085 242/423
8,317,124 B2 * 11/2012 Yu Chen ..... B65B 67/085 242/588.6
9,284,085 B2 * 3/2016 Pace ..... B65B 67/085
9,850,011 B2 * 12/2017 Nelson ..... B65B 61/00
9,908,738 B1 * 3/2018 Toth ..... B65H 49/28
2006/0245890 A1 * 11/2006 Hartman ..... B65D 19/0022 414/607
2006/0289693 A1 * 12/2006 Saavedra ..... B62B 1/26 242/557

(Continued)

*Primary Examiner* — Michael E Gallion
(74) *Attorney, Agent, or Firm* — Karin L. Williams; Mayer & Williams PC

(57) ABSTRACT

A dispenser for a construction string, cord, or wire contains: an end member, a handle member, and a fixer. The end member includes a first stem formed on a first end thereof, a second stem arranged on a second end thereof and separated from the first stem by a shoulder, a disposable spool fitted on the second stem on which two opposite first ribs extend away from the shoulder, a fitting part defined between the two opposite first ribs, a notch defined on a top of the fitting part, and inner threads formed on an inner wall of the notch. The handle member is rotatably connected with the first stem. The fixer includes a body and a threaded post extending outward from the body, wherein the threaded post has outer threads arranged on an outer wall thereof so as to screw with the inner threads of the notch.

9 Claims, 6 Drawing Sheets

(56) References Cited

U.S. PATENT DOCUMENTS

| | | | | |
|---|---|---|---|---|
| 2007/0095025 | A1* | 5/2007 | Yu Chen | B65B 67/085<br>53/556 |
| 2011/0198430 | A1* | 8/2011 | Rothell | B65H 49/305<br>242/401 |

* cited by examiner

DISPENSER CONSTRUCTION STRING, CORD, OR WIRE

FIELD OF THE INVENTION

The present invention relates to a dispenser for a construction string, cord, or wire which is adjustable so as to receive various sizes of spools.

BACKGROUND OF THE INVENTION

Elongate material dispensers using disposable spools have been in use for years. Conventional elongate materially dispensers are formed for receiving and dispensing a disposable spool of material such as barricade tape, flagging tape, construction string, rope, wire and other elongate materials.

A conventional elongate material dispenser system contains a positive locking structure for retaining a disposable spool regardless of the physical state of the spool's cardboard core. The elongate material dispenser system includes a handle member having a handle shoulder, a handle shank having a first prong and a second prong extending from the handle member, an end member having an end shoulder, a tongue member having a plurality of first teeth and a plurality of second teeth, a first cross member having a first positive member, and a second cross member having a second positive member. The first positive member and the second positive member catchably engage the second teeth within the tongue member. The resilient prongs retain the first positive member and the second positive member in engagement with the second teeth regardless of the physical state of the core.

However, the elongate material dispenser system of the present invention has defects as follows:

1. The elongate material dispenser system cannot adjust distance of the handle member so as to receive various sizes of spools.
2. The end member removes from the spool easily.
3. The engaging members of the elongate material dispenser system are elongated so as to damage easily after a period of using time.

The present invention has arisen to mitigate and/or obviate the afore-described disadvantages.

SUMMARY OF THE INVENTION

The primary aspect of the present invention is to provide a dispenser for a construction string, cord, or wire which is adjustable so as to receive various sizes of spools.

Further aspect of the present invention is to provide a dispenser for a construction string, cord, or wire in which the width of the slot is less than a diameter of the threaded post, and the threaded post contacts with the notch of the fitting part and does not remove from the slot, thus fixing the fixer securely.

Another aspect of the present invention is to provide a dispenser for a construction string, cord, or wire in which the two opposite arcuate flaps reinforces the fitting part so as to prolong a service life of the fitting part.

To obtain above-mentioned aspects, a dispenser provided by the present invention contains: an end member, a handle member, and a fixer.

The end member includes a first stem formed on a first end of the end member, a second stem arranged on a second end of the end member and separated from the first stem by a shoulder, a disposable spool fitted on the second stem on which two opposite first ribs extend away from the shoulder, a fitting part integrally defined between the two opposite first ribs, a notch defined on a top of the fitting part, and inner threads formed on an inner wall of the notch.

The handle member is rotatably connected with the first stem of the end member.

The fixer includes a body and a threaded post extending outward from the body, wherein the threaded post has outer threads arranged on an outer wall of the threaded post so as to screw with the inner threads of the notch.

DETAILED DESCRIPTION OF THE PREFERRED EMBODIMENTS

Figure 1:
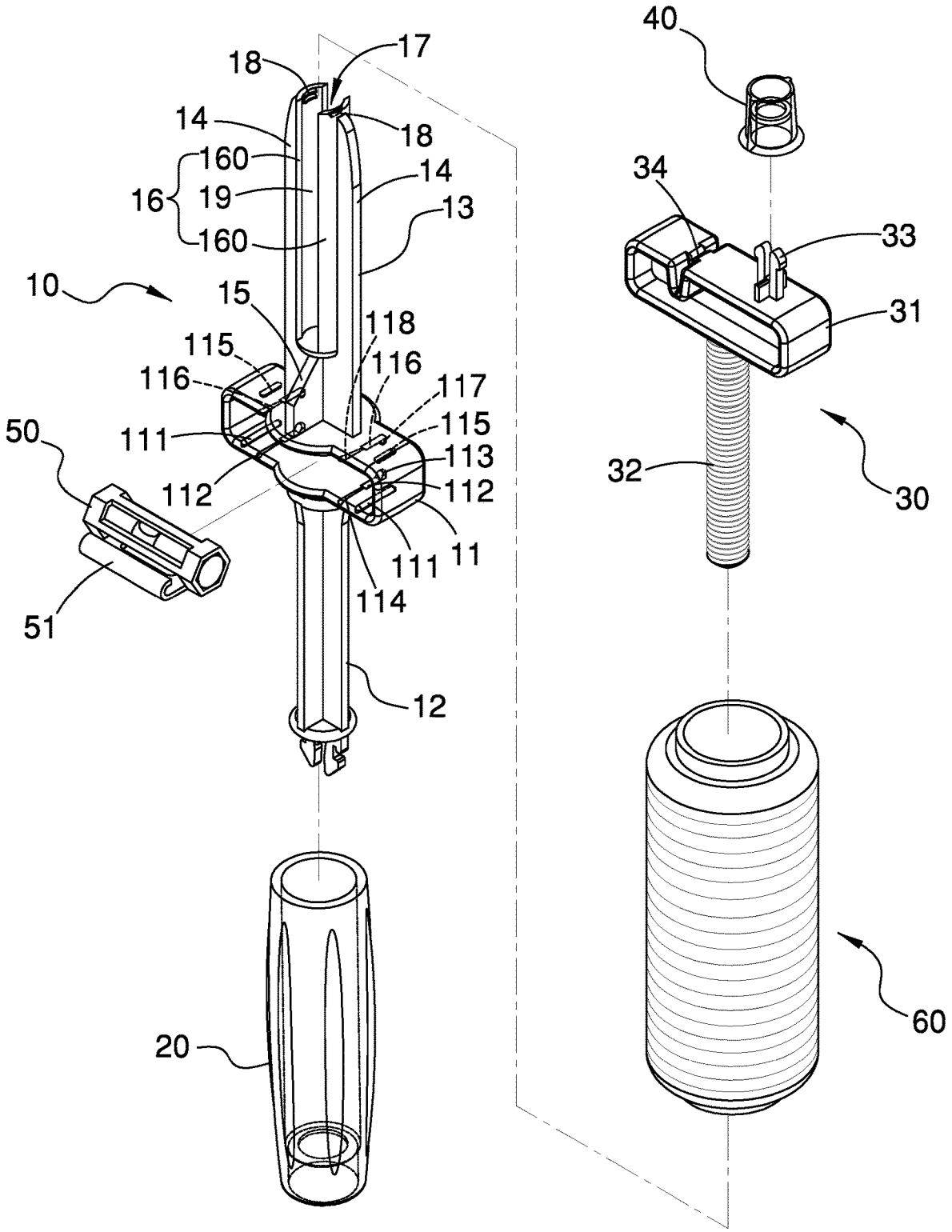
FIG. 1 is a perspective view showing the exploded components of a dispenser for a construction string, cord, or wire according to a preferred embodiment of the present invention.
Figure 2:
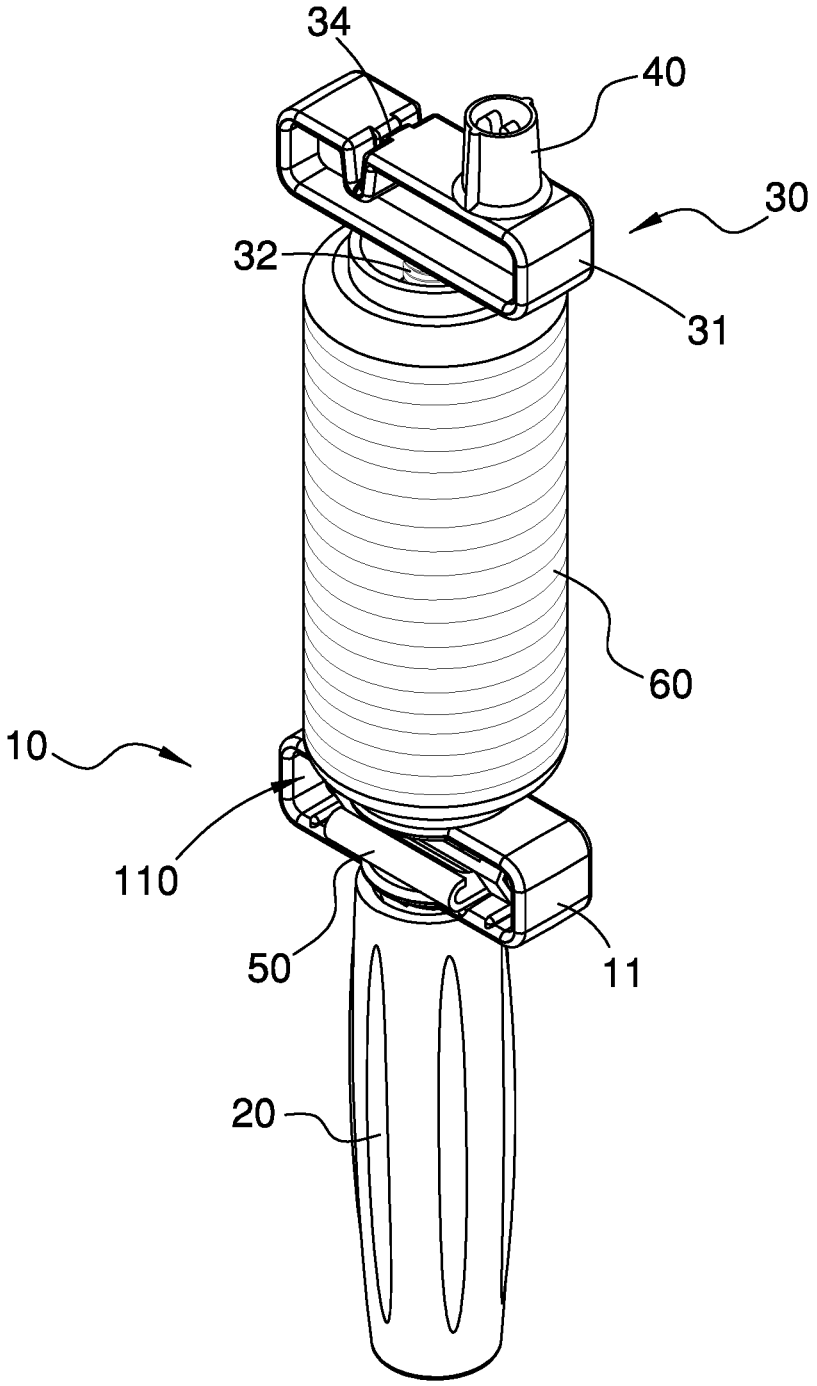
FIG. 2 is a perspective view showing the assembly of the dispenser for the construction string, cord, or wire according to the preferred embodiment of the present invention.
Figure 3:
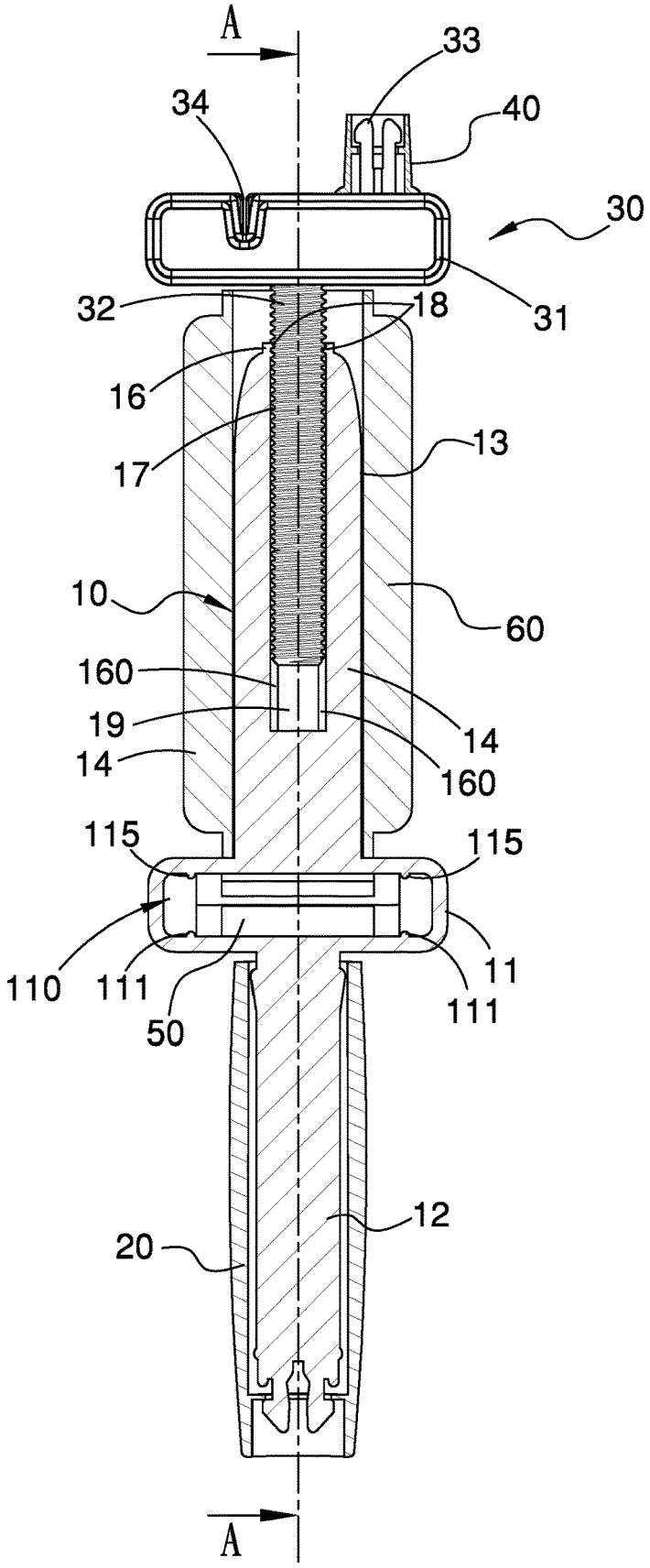
FIG. 3 is a cross sectional view showing the assembly of the dispenser for the construction string, cord, or wire according to the preferred embodiment of the present invention.
Figure 4:
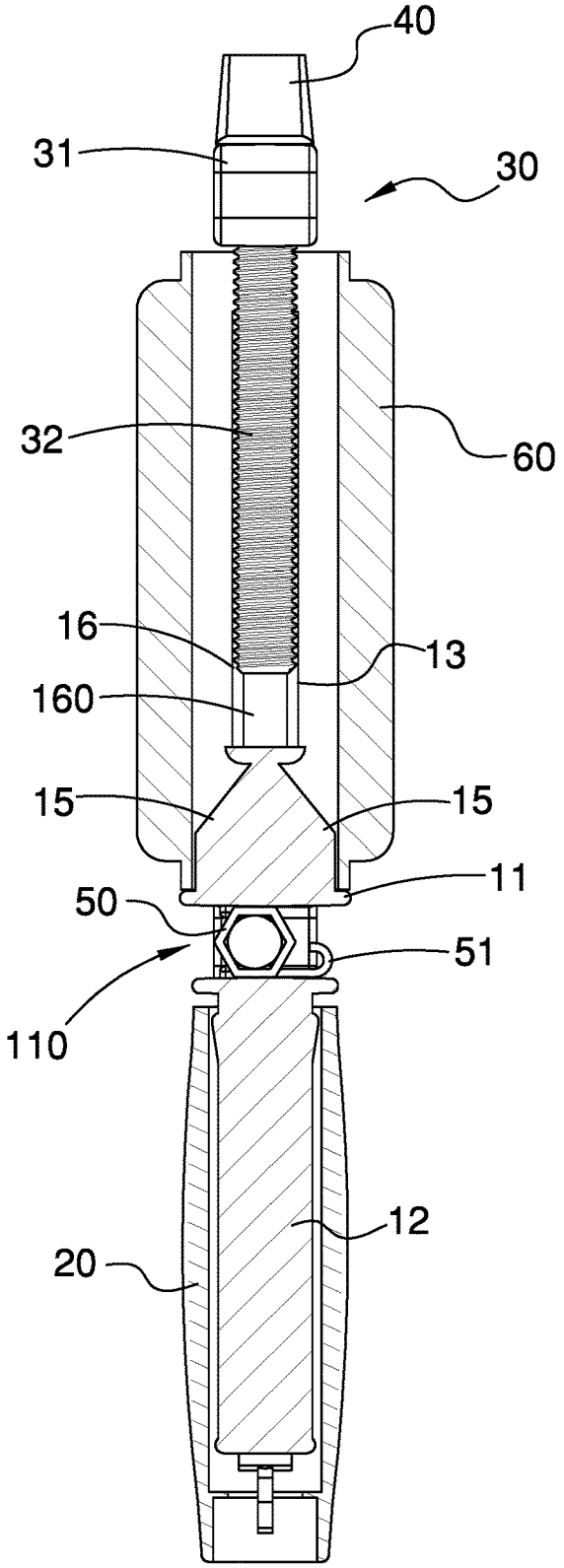
FIG. 4 is a cross sectional view taken along the line of A-A of FIG. 3.

With reference to FIGS. 1-5, a dispenser for a construction string, cord, or wire according to a preferred embodiment of the present invention comprises: an end member 10, a handle member 20, a fixer 30, a knob 40, and a level 50.

The end member 10 includes a first stem 12 formed on a first end thereof, a second stem 13 arranged on a second end of the end member 10 and separated from the first stem 12 by a shoulder 11, wherein the shoulder 11 has an accommodation groove 110 defined therein, and a disposable spool 60 is fitted on the second stem 13 on which two opposite first ribs 14 extend away from the shoulder 11 and two opposite second ribs 15 extend close to the shoulder 11 so that the two opposite first ribs 14 and the two opposite second ribs 15 abut against an inner wall of the disposable spool 60. A fitting part 16 is integrally defined between the two opposite first ribs 14, and the fitting part 16 has a notch 17 defined on a top thereof, inner threads 18 formed on an inner wall of the notch 17, and a slot 19 defined inside and passing through the fitting part 16, wherein a width of the slot 19 is less than a diameter of the notch 17, the fitting part 16 further has two opposite arcuate flaps 160 arranged adjacent to the slot 19 and perpendicular to two opposite first ribs 14, wherein two opposite openings of the slot 19 correspond to the two opposite second ribs 15 respectively.

The handle member 20 is cylindrical and is rotatably connected with the first stem 12 of the end member 10 so as to be gripped by user.

The fixer 30 includes a body 31, a threaded post 32, and a rotatable retainer 33, wherein the body 31 has a recess 34 defined on a top thereof so as to fix the construction string, cord, or wire on the disposable spool 60, and the threaded post 32 extends outward from a central position of a bottom of the body 31 and has outer threads arranged on an outer wall of the threaded post 32 so as to screw with the inner threads 18 of the notch 17, hence the threaded post 32 is screwed in the notch 17. In addition, the rotatable retainer 33 is located on the body 31 away from the recess 34.

The knob 40 is rotatably connected on the rotatable retainer 33.

The level 50 is detachably retained in the accommodation groove 110, and the level 50 includes a hook 52 configured to hook the construction string, cord, or wire so as to detect whether the construction string, cord, or wire is arranged horizontally, and the level 50 includes at least one plane configured to abut against a construction object so as to detect whether the construction object is flat.

Figure 5:
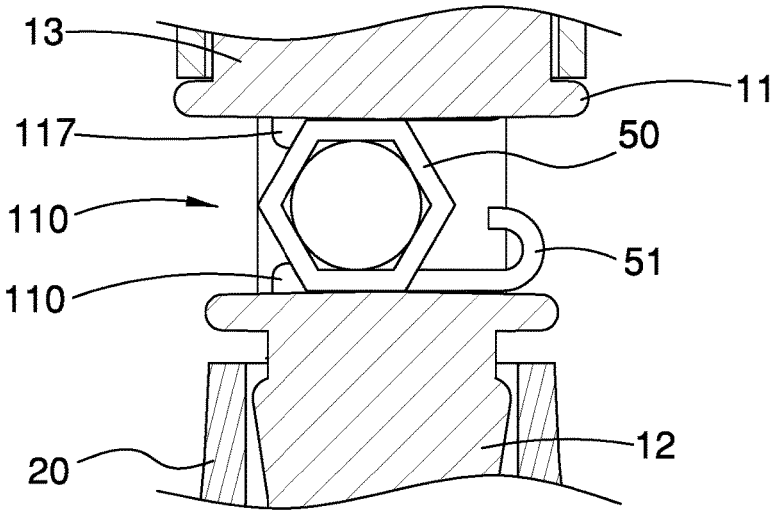
FIG. 5 is a cross sectional view showing the operation of a part of the dispenser for the construction string, cord, or wire according to the preferred embodiment of the present invention.
Figure 6:
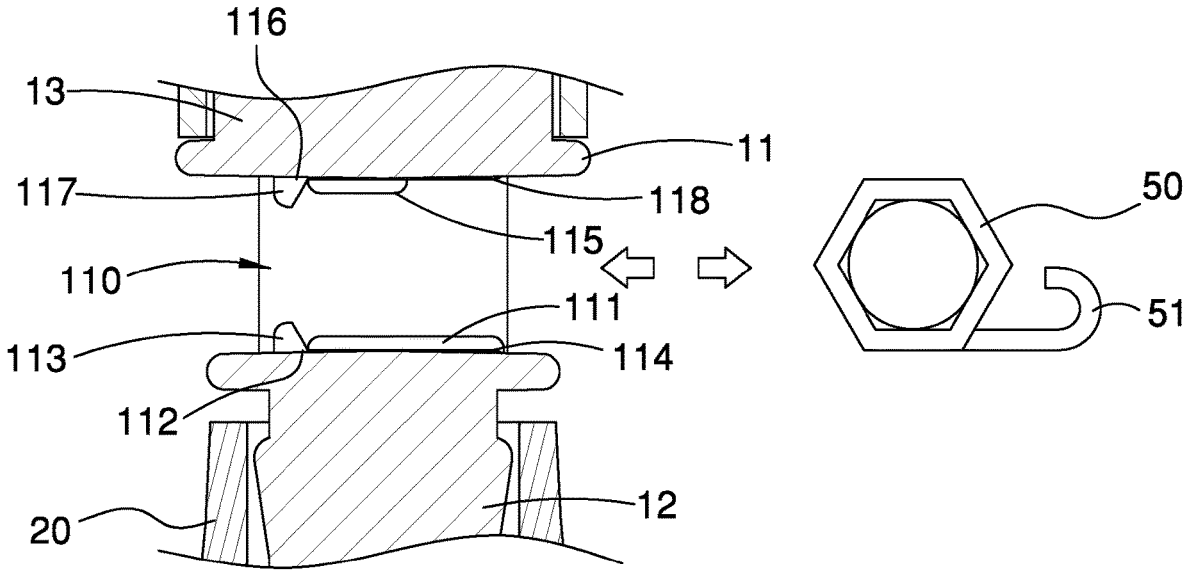
FIG. 6 is another cross sectional view showing the operation of a part of the dispenser for the construction string, cord, or wire according to the preferred embodiment of the present invention.

Referring further to FIGS. 5 and 6, the accommodation groove 11 has two first limiting elements 111 arranged on a bottom thereof, two first abutting elements 112 formed on the bottom of the accommodation groove 11 between the two first limiting elements 111, two first protrusions 113 formed on first ends of the two first abutting elements 112 individually, two first clampers 114 arranged on second ends of the two first abutting elements 112 respectively, two second limiting elements 115 arranged on an inner wall of a top of the accommodation groove 110, and two second abutting elements 116 formed on the inner wall of the top of the accommodation groove 11 between the two second limiting elements 115, two second protrusions 117 formed on first ends of the two second abutting elements 116 individually, and two second clampers 118 arranged on second ends of the two second abutting elements 116 respectively. The level 50 is retained in the accommodation groove 110 so as to be firmly fixed by the two first limiting elements 111 and the two second limiting elements 115, The level 50 is retained in the accommodation groove 110 so that two ends of the level 50 are fixed by the two first limiting elements 111 and the two second limiting elements 115, a rear surface of the level 50 is stopped by the two first protrusions 113 and the two second protrusions 117, and the top and the bottom of the level 50 are retained by the two first clampers 114 and the two second clampers 118, thus fixing the level 50 in the accommodation groove 110. After removing the level 50 from the accommodation groove 110, it is used to detect whether the construction string, cord, wire, or object is flat.

Figure 7:
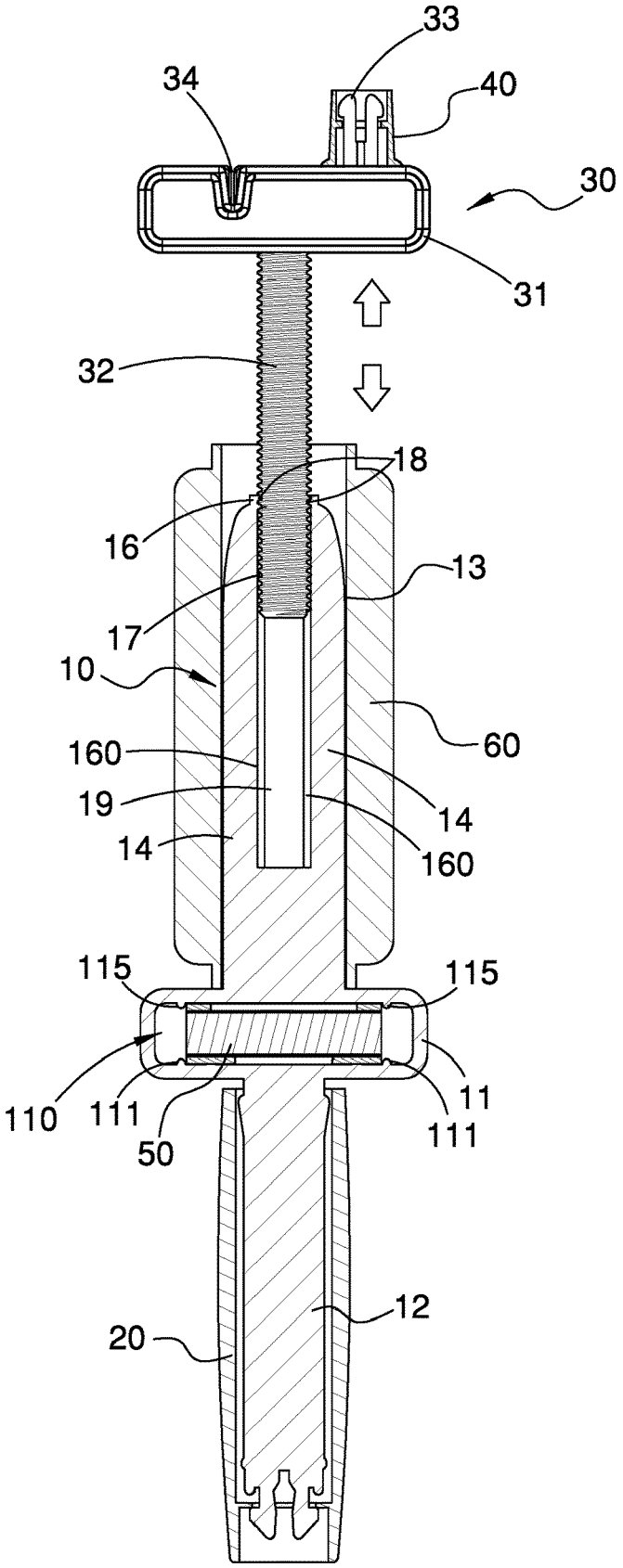
FIG. 7 is a cross sectional view showing the operation of the dispenser for the construction string, cord, or wire according to the preferred embodiment of the present invention.

As shown in FIG. 7, the fixer 30 is rotated so that the outer threads of the threaded post 32 screw with the inner threads 18 of the notch 17, and the threaded post 32 is movably screwed in the notch 17 until the disposable spool 60 is clamped by the body 31 and the accommodation groove 11.

Accordingly, the dispenser of the present invention has advantages as follows:

1. The outer threads of the threaded post 32 screw with the inner threads of the notch 17 so that the fixer 30 screws on the second stem 13 of the end member 10, and a distance between the body 31 and the accommodation groove 11 is adjustable so as to receive various sizes of spools 60.

2. The width of the slot 19 is less than a diameter of the threaded post 32, and the threaded post 32 contacts with the notch 17 of the fitting part 16 and does not remove from the slot 19, thus fixing the fixer 30 securely.

3. The two opposite arcuate flaps 160 reinforces the fitting part 16 so as to prolong a service life of the fitting part 16.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A dispenser for a construction string, cord, or wire comprising:

an end member including a first stem formed on a first end of the end member, a second stem arranged on a second end of the end member and separated from the first stem by a shoulder, a disposable spool fitted on the second stem on which two opposite first ribs extend away from the shoulder, a fitting part integrally defined between the two opposite first ribs, a notch defined on a top of the fitting part, and inner threads formed on an inner wall of the notch;

a handle member rotatably connected with the first stem of the end member; and a fixer including a body and a threaded post extending outward from the body, wherein the threaded post has outer threads arranged on an outer wall of the threaded post so as to screw with the inner threads of the notch.

2. The dispenser as claimed in claim 1, wherein a slot is defined inside and passes through the fitting part, and the fitting part further has two opposite arcuate flaps arranged adjacent to the slot and perpendicular to two opposite first ribs.

3. The dispenser as claimed in claim 2 further comprising a level detachably retained in an accommodation groove of the shoulder, wherein the level includes a hook configured to hook the construction string, cord, or wire so as to detect whether the construction string, cord, or wire is arranged horizontally.

4. The dispenser as claimed in claim 3, wherein the accommodation groove has two first limiting elements arranged on a bottom thereof, two first abutting elements formed on the bottom of the accommodation groove between the two first limiting elements, two first protrusions formed on first ends of the two first abutting elements individually, two first clampers arranged on second ends of the two first abutting elements respectively, two second limiting elements arranged on an inner wall of a top of the accommodation groove, and two second abutting elements formed on the inner wall of the top of the accommodation groove between the two second limiting elements, two second protrusions formed on first ends of the two second abutting elements individually, and two second clampers arranged on second ends of the two second abutting elements respectively.

5. The dispenser as claimed in claim 3, wherein two opposite second ribs extend close to the shoulder, and the two opposite first ribs and the two opposite second ribs abut against an inner wall of the disposable spool.

6. The dispenser as claimed in claim 3, wherein the inner threads of the notch are located adjacent to a top of the notch.

7. The dispenser as claimed in claim 3 further comprising a knob rotatably connected on a rotatable retainer of the fixer, and the rotatable retainer is located on the body away from the recess.

8. The dispenser as claimed in claim 3, wherein the body has a recess defined on a top thereof so as to fix the construction string, cord, or wire on the disposable spool.

9. The dispenser as claimed in claim 3, wherein the level includes at least one plane configured to abut against a construction object.

* * * * *